US006702178B2

(12) United States Patent
Bowers et al.

(10) Patent No.: US 6,702,178 B2
(45) Date of Patent: Mar. 9, 2004

(54) SANDWICH WRAP

(75) Inventors: Debra D. Bowers, Menasha, WI (US); Rebecca E. Whitmore, Chilton, WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 10/141,576

(22) Filed: May 9, 2002

(65) Prior Publication Data

US 2002/0148882 A1 Oct. 17, 2002

Related U.S. Application Data

(63) Continuation of application No. 09/634,922, filed on Aug. 9, 2000, now abandoned.
(60) Provisional application No. 60/148,074, filed on Aug. 10, 1999.

(51) Int. Cl.[7] ..... B65D 75/00

(52) U.S. Cl. ..... 229/87.08; 229/87.05; 229/938; 426/122

(58) Field of Search ..... 229/87.08, 938, 229/87.05, 103.2, 243, 87.09; 426/122

(56) References Cited

U.S. PATENT DOCUMENTS

| | | | | |
|---|---|---|---|---|
| 1,474,088 A | | 11/1923 | Reynolds | |
| 1,966,394 A | | 7/1934 | Hunnel | |
| 2,128,843 A | * | 8/1938 | Mullins | 426/5 |
| 2,679,349 A | | 5/1954 | Mullinix | |
| 2,947,637 A | | 8/1960 | Fobiano | |
| 2,987,402 A | * | 6/1961 | Dold | 426/106 |
| 3,964,669 A | | 6/1976 | Sontag et al. | |
| 4,328,896 A | * | 5/1982 | Behne | 206/497 |
| 4,575,000 A | | 3/1986 | Gordon et al. | |
| 4,623,568 A | | 11/1986 | Suzuki | |
| 4,754,914 A | | 7/1988 | Wischusen, III | |
| 5,042,666 A | | 8/1991 | Dolene | |
| 5,067,612 A | | 11/1991 | Tsuchiya et al. | |
| 5,094,863 A | | 3/1992 | Vandenburg | |

* cited by examiner

*Primary Examiner*—Jes F. Pascua
(74) *Attorney, Agent, or Firm*—Fulbright & Jaworski L.L.P.

(57) ABSTRACT

A sandwich wrap comprising a sheet wrap attached to a base strip The base strip is elonaated in a longitudinal direction and includes at least one tear line extending between the longitudinal ends. The base strip is longer than the sheet wrap in the longitudinal direction, while the sheet wrap is longer than the base strip in the lateral direction. The longitudinal ends of the base strip extend beyond the respective longitudinal edges of the sheet wrap. The sheet wrap is more pliable than the base strip.

20 Claims, 4 Drawing Sheets

SANDWICH WRAP

PRIOR APPLICATION

This application is a continuation of application Ser. No. 09/634,922, filed on Aug. 9, 2000, now abandoned, and which claims priority under 35 U.S.C. §119 to U.S. Provisional Application No. 60/148,074 filed Aug. 10, 1999, the entire content of which is hereby incorporated by reference.

FIELD OF THE INVENTION

The present invention generally relates to sheet wraps for wrapping food products. More particularly, the present invention pertains to sandwich wraps useful in wrapping sandwiches, and to a method of unwrapping a sandwich.

BACKGROUND OF THE INVENTION

Food products, such as sandwiches, that are sold in fast food-type of restaurants are typically packaged in one of several different types of packages to protect the food product until it is consumed. One type of package involves the use of flat paper sheet wrap. The sandwich is placed on a flat paper sheet which is then folded around the sandwich. The paper sheet is typically held in place by tucking the free edges or corners of the sheet under the sandwich. The wrapped sandwich can then be placed in a storage bin for future sale or may be placed in a bag for being carried out of the restaurant.

It has been found, however, that this type of packaging suffers from several disadvantages. In one respect, when the packaged sandwich is placed in a storage bin for later sale or in a bag for transportation and later consumption, the paper sheet wrap has a tendency to come unwrapped.

Known paper sheet wraps include minimal crush-resistant properties, such as rigidity, to help prevent a packaged or wrapped sandwich from being crushed. Consequently, sandwiches packages in such materials are prone to being crushed when stored in a storage bin or placed in a bag with other items. Although other types of packaging materials such as foam and paperboard cartons have been used to protect the packaged sandwich, these cartons require a significant amount of storage space as a result of their construction. Also, it is necessary for the consumer to remove the sandwich from the carton in order to eat it. That can involve sanitary problems, for example, in the case of sandwiches purchased at a drive-through window of a restaurant, since the consumer normally would not be able to wash his or her hands before eating, and may attempt to consume the sandwich while riding in, or even driving, a moving (bouncing) vehicle. Food items such as lettuce, pickles, chopped onions, tomatoes, etc. may fall from the sandwich and onto the consumer as it is being eaten under those conditions.

SUMMARY OF THE INVENTION

The present invention relates to a sandwich wrap comprising a base strip and a sheet wrap attached thereto. The base strip is elongated in a longitudinal direction and includes at least one tear line extending substantially between the longitudinal ends. Two tear lines may also be included, forming a tear strip therebetween. The sheet wrap is shorter than the base strip in the longitudinal direction and longer than the base strip in the lateral direction. When attached, the longitudinal ends of the base strip extend beyond respective longitudinal edges of the sheet wrap. The sheet wrap is also more pliable than the base strip. The base strip and the sheet wrap sections may be folded around a sandwich. Thusly packaged, the sandwich is accessible by severing the sandwich wrap along the tear line, to separate the base strip into respective sections, at least one of which may be removed.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
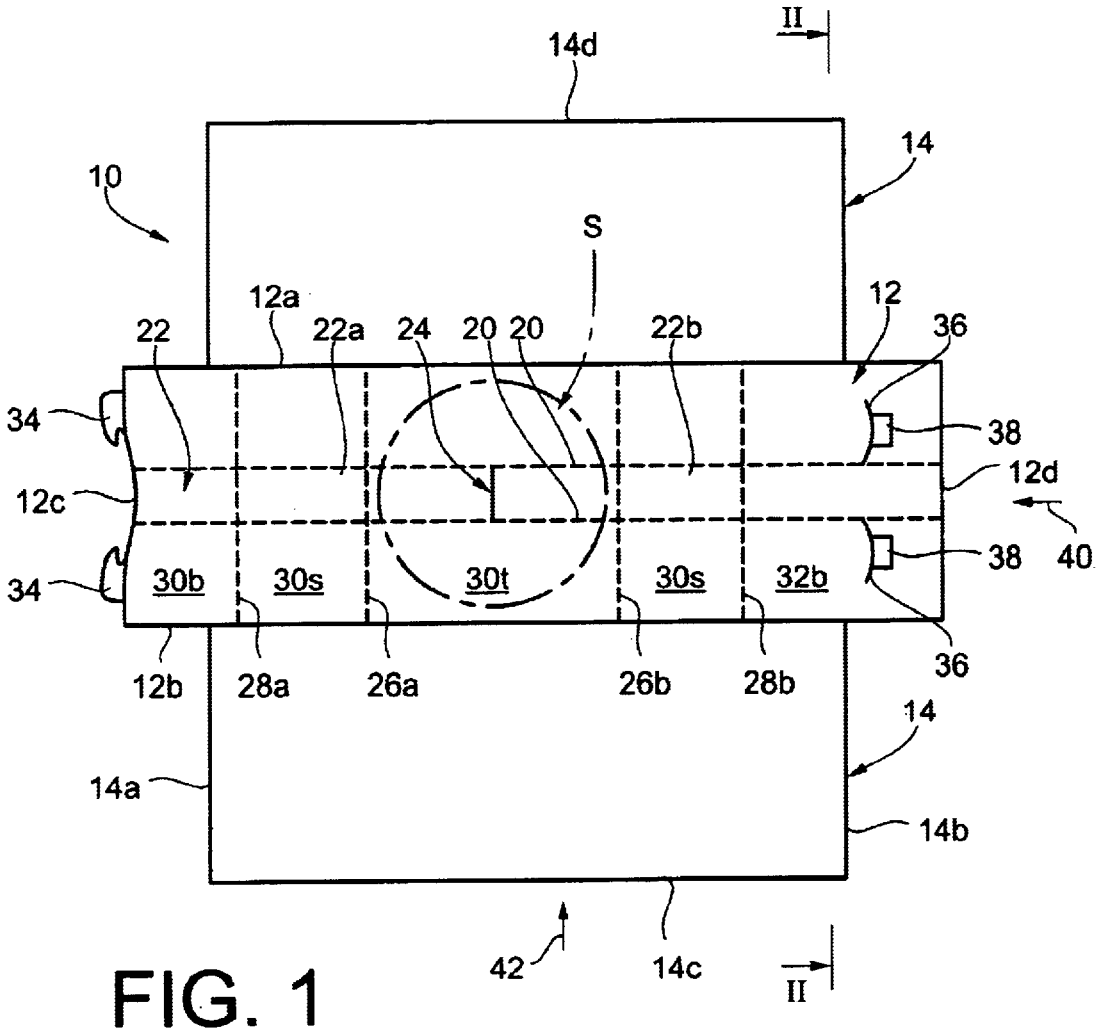
FIG. 1 is a top plan view of a sandwich wrap according to a first embodiment of the present invention.
Figure 2:
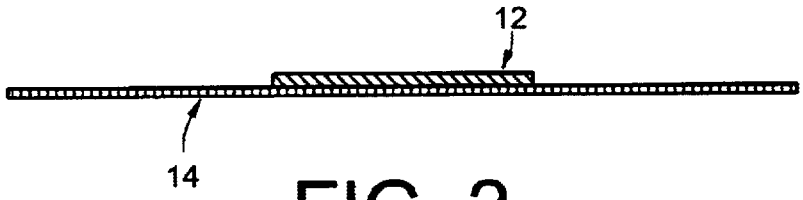
FIG. 2 is a cross-sectional view taken along the line II—II in FIG. 1.

A sandwich wrap 10 depicted in FIG. 1 comprises a relatively stiff base strip 12 and a highly pliant sheet wrap 14 attached thereto. The base strip 12 and the sheet 14 are both generally rectangular in shape, with the long side edges 12*a*, 12*b* of the base strip 12 defining the longitudinal direction. Longitudinally, the base strip 12 is longer than the sheet 14, with the opposite longitudinal ends 12*c*, 12*d* of the base strip extending beyond the respective longitudinal edges 14*a*, 14*b* of the sheet 14. Laterally, the base strip 12 is shorter than the sheet 14, with the lateral end edges 14*c*, 14*d* of the sheet 14 extending beyond the respective lateral edges 12*a*, 12*b* of the base strip 12. The base strip 12 could be of any suitable type, such as paperboard or plastic, for example, and the sheet 14 could be any suitable light-weight sheet material, such as tissue paper for example.

Alternatively, if heat retention properties are desired, the sheet could comprise a Quilt-Rap® material typically in the form of a three-ply laminated structure consisting of a polyethylene layer laminated between two outer paper layers (e.g., tissue paper).

The base strip 12 contains a pair of parallel longitudinal tear lines 20, defining a tear strip 22 therebetween. The tear lines 20 extend substantially the entire length of the base strip 12, running between one longitudinal end 12*c* to the other longitudinal end 12*d*. The sheet 14 also includes a pair of tear lines that are substantially aligned with the tear lines 20 in the base strip 12. With tear lines in both the base strip 12 and the sheet 14, the sandwich wrap 10 may be divided into separate parts when the tear strip 22 is removed as described below. The tear strip 22 is severed near its midpoint by a transverse cut line 24 to be divided into a pair of tear strip sections 22*a,* 22*b*. The tear lines 20 could extend in the machine direction or the cross direction of the base strip 12.

The base strip 12 also includes a plurality of parallel, transverse fold lines 26*a*, 26*b,* 28*a,* 28*b* formed by transverse score lines. The fold lines divide the base strip 12 longitudinally into a top panel 30*t*, a pair of identical side panels 30*s*, and a pair of bottom panels 30*b,* 32*b*.

The longitudinal ends 12*c,* 12*d* can be secured together by connecting elements. For example at one end of the base strip 12, i.e., along an edge of the bottom panel 30*b*, there is provided a pair of lock tabs 34, and the other bottom panel 32*b* contains a pair of slits 36 intersected by respective apertures 38. As will be explained, the slits 36 are adapted to receive respective back tabs 34. Alternative to the use of two of the tabs, a single tab and slit could be employed.

Figure 3:
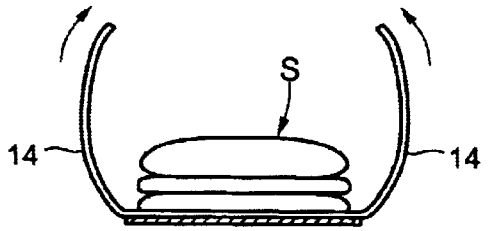
FIG. 3 is a view taken in the direction of arrow 40 in FIG. 1 as the sheet portion of the wrap is being folded onto a sandwich.
Figure 4:
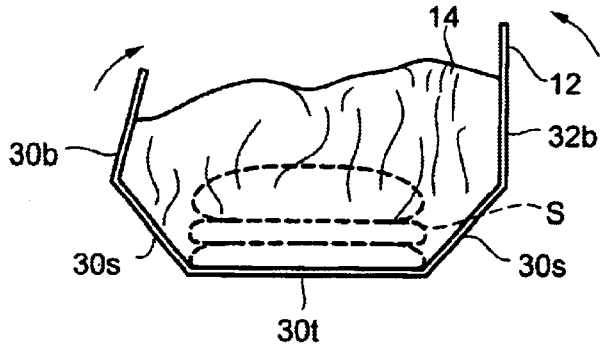
FIG. 4 is a view taken in the direction of arrow 42 in FIG. 1 as the base strip is being folded around the sandwich.
Figure 5:
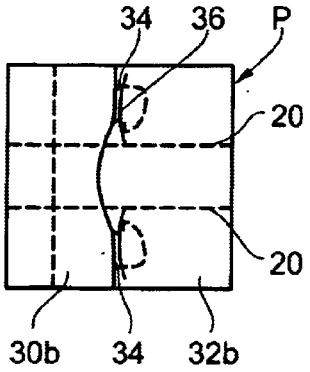
FIG. 5 is a bottom view of a package formed in accordance with the present invention.
Figure 6:
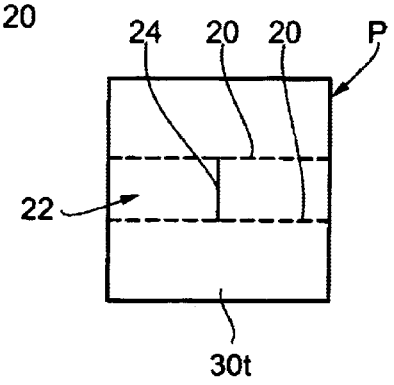
FIG. 6 is a top view of the package depicted in FIG. 5.
Figure 7:
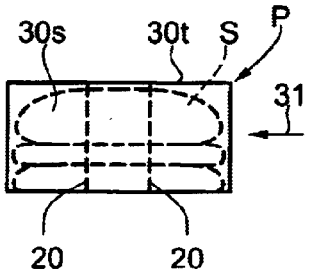
FIG. 7 is a side elevational view of the package depicted in FIGS. 5 and 6.

To use the sandwich wrap 10, the wrap would be placed on a support surface, and a sandwich S would be placed on the wrap in overlying relationship to the top panel 30*t* (see the phantom lines in FIG. 1). Then, the sheet 14 is folded up and over the sandwich, as shown in FIG. 3 which is a view taken in the direction of arrow 40 in FIG. 1. At the same time, the longitudinal ends of the strip base 12 are raised, as shown in FIG. 4 which is a view taken in the direction of arrow 42 in FIG. 1. The base strip 22 is folded along the score lines 26*a,b* and 28*a,b,* whereby the bottom panels 30*b,* 32*b* come together at the top of the sandwich, and the locking tabs 34 are inserted into respective slits 36 to lock the bottom panels together, as shown in FIG. 5. The resulting package P comprised of the sandwich S and the wrap 10 is then flipped over to expose the top panel 30*t* (FIG. 6).

The consumer has two options for eating the sandwich. For example, the consumer can unlock the tabs 34, unfold the wrap, and pick the sandwich out of the wrap. That could be the method of choice if the consumer were, for example, eating the sandwich at a table.

Figure 8:
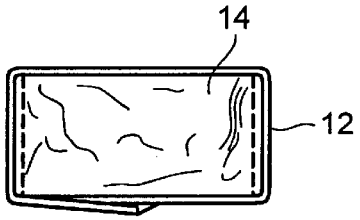
FIG. 8 is a side view taken in the direction of arrow 31 in FIG. 7 or in the direction of arrow 54 in FIG. 12.
Figure 10:
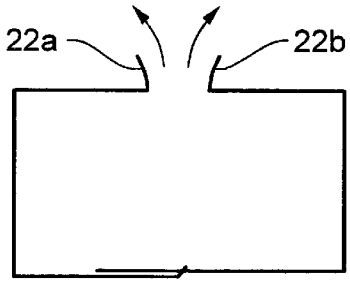
FIG. 10 is a schematic side elevational view depicting the manner of removing the tear strip sections.
Figure 9:
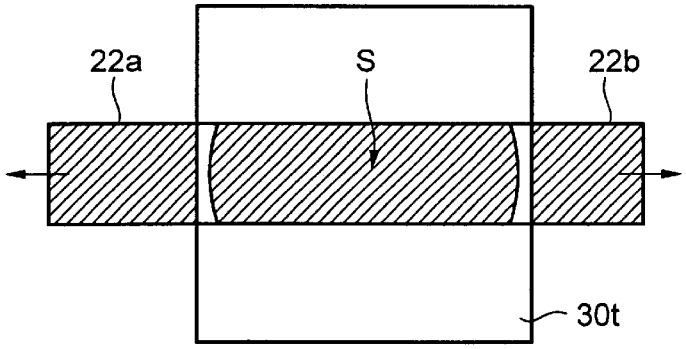
FIG. 9 is a view similar to FIG. 6 as sections of a tear strip are in the process of being removed.
Figure 11:
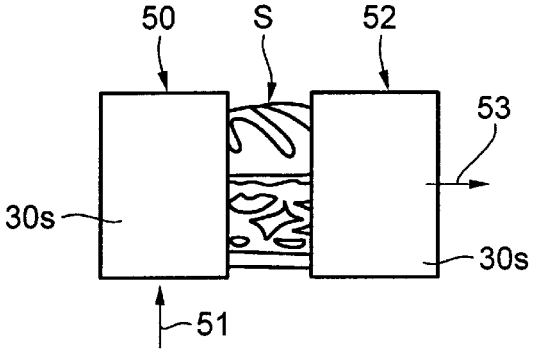
FIG. 11 is a side elevational view of the package after the tear strip has been completely removed to divide the wrap into half-sections.
Figure 12:
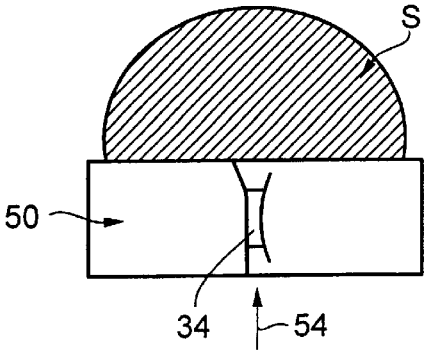
FIG. 12 is a view taken in the direction of arrow 51 in FIG. 11 after one of the half sections of the wrap has been discarded in the direction of arrow 53 in FIG. 11.
Figure 13:
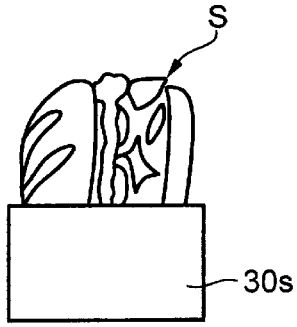
FIG. 13 is a view similar to FIG. 12 of another side of the package.

The other option involves pulling off the tear strip sections 22*a,* 22*b* to divide the wrap 10 into two separate sections 50,52. Then, one of the sections 52 is discarded in the direction of arrow 53, leaving the sandwich S seated in the other of the sections (e.g., section 50—see FIG. 12) which can be held by the consumer to grip the sandwich as he/she eats the sandwich. Sanitary conditions are maintained, because the consumer's hands do not come into direct contact with the sandwich, and any food items (e.g., lettuce, onions, pickles, tomatoes, sauce, etc.) dropping from the sandwich fall onto the sheet 14 (see FIG. 8 which is a view in the direction of the arrow 54 of FIG. 12). That could be the method of choice if the consumer were eating the sandwich in a vehicle, or from his/her lap.

Figure 14:
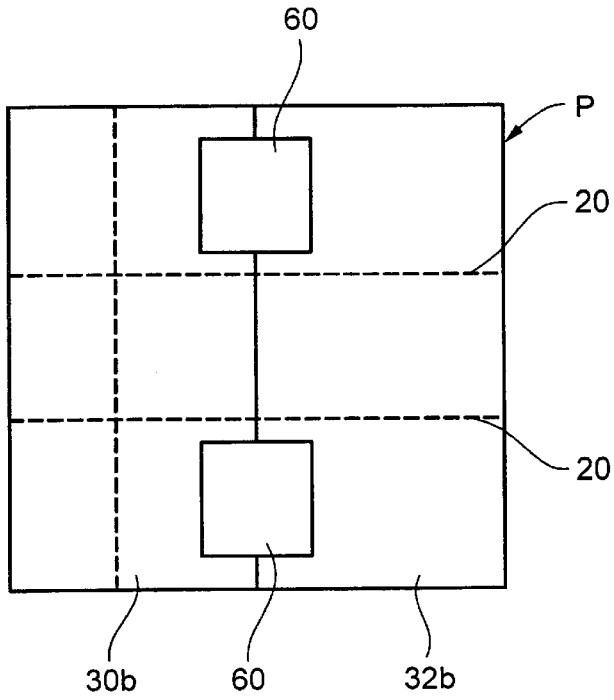
FIG. 14 is a view similar to FIG. 5 of an alternative embodiment according to the present invention.

The longitudinal ends of the base strip can be secured together by any suitable connecting means other than a locking tab arrangement. For example, the longitudinal ends could be secured by adhesive, e.g., adhesive strips, or pieces of tape 60, as shown in FIG. 14. The tape pieces could be initially attached to one of the end edges and then attached to the other end edge after removing pieces of backing material. In the event that it is not intended to give the user the option of separating the ends of the base strip from one another, the tape or adhesive strips could be of the non-removable type. Then, the consumer would be required to remove the tear strip 22.

Figure 15:
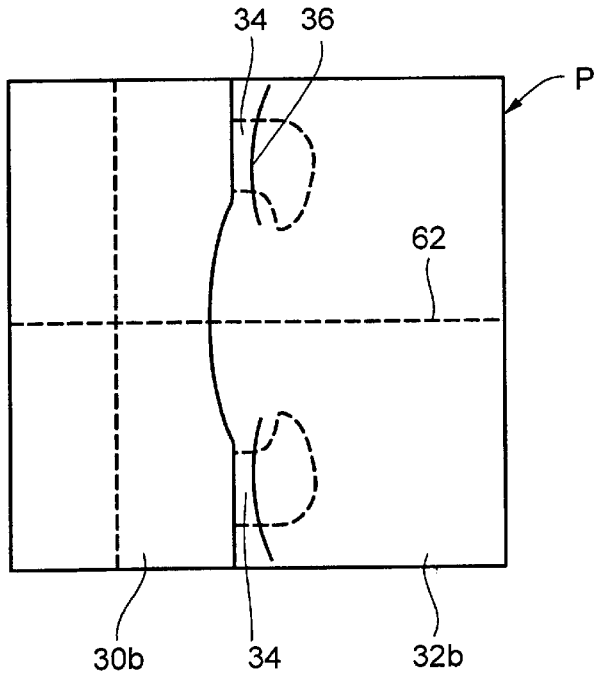
FIG. 15 is a view similar to FIG. 5 of yet another alternative embodiment according to the invention.

Also, instead of providing a pair of tear lines 20 for forming a tear strip 22, there could instead be formed only a single tear line 62, as shown in FIG. 15, to be severed by the consumer.

Although the present invention has been described in connection with preferred embodiments thereof, it will be appreciated by those skilled in the art that additions, deletions, modifications, and substitutions not specifically described may be made.

What is claimed is:

1. A sandwich wrap comprising:

a base strip elongated in a longitudinal direction, the base strip including opposing longitudinal ends and at least one first tear line extending substantially between the longitudinal ends; and a sheet wrap attached to the base strip, the sheet wrap being shorter than the base strip in the longitudinal direction, longer than the base strip in a lateral direction, and more pliable than the base strip, wherein the longitudinal ends of the base strip extend beyond respective longitudinal edges of the sheet wrap and wherein the opposing longitudinal ends of the base strip include at least one tab formed on one longitudinal end for securement in a respective slit formed in the other longitudinal end.

2. The sandwich wrap according to claim 1 wherein the at least one first tear line comprises perforations.

3. The sandwich wrap according to claim 1 wherein there are two of the tear lines extending parallel to one another to define a tear strip.

4. The sandwich wrap according to claim 3 wherein the tear strip extends from one longitudinal end of the base strip to the other longitudinal end.

5. The sandwich wrap according to claim 4 wherein the tear strip includes a transverse cut line, which divides the tear strip into two tear strip sections.

6. The sandwich wrap according to claim 1 wherein the base strip includes a plurality of fold lines extending perpendicular to the longitudinal direction.

7. The sandwich wrap according to claim 1 wherein the sheet wrap comprises paper.

8. The sandwich wrap according to claim 1 wherein the base strip comprises paperboard.

9. The sandwich wrap of claim 1, wherein the sheet wrap includes at least one second tear line substantially aligned with the at least one first tear line.

10. A sandwich wrap comprising:

a base strip elongated in a longitudinal direction, the base strip including opposing longitudinal ends, at least one first tear line extending substantially between the longitudinal ends, and a plurality of fold lines extending substantially in a lateral direction of the base strip; and a sheet wrap attached to the base strip and including at least one second tear line substantially aligned with the at least one first tear line, the sheet wrap being shorter than the base strip in the longitudinal direction, longer than the base strip in the lateral direction, and more pliable than the base strip, wherein the longitudinal ends of the base strip extend beyond respective longitudinal edges of the sheet wrap, the base strip including at least one tab at one longitudinal end and at least one slit at the other longitudinal end, wherein the at least one tab is adapted to be securable within the at least one slit when the base strip is folded.

11. The sandwich wrap of claim 10, wherein the at least one first tear line comprises perforations.

12. The sandwich wrap of claim 10, wherein the at least one first tear line includes two parallel tear lines defining a tear strip.

13. The sandwich wrap of claim 12, wherein the tear strip extends from one longitudinal end of the base strip to the other longitudinal end.

14. The sandwich wrap of claim 13, wherein the tear strip includes a transverse cut line dividing the tear strip into two tear strip sections.

15. The sandwich wrap of claim 10, wherein the sheet wrap comprises paper.

16. The sandwich wrap of claim 10, wherein the base strip comprises paperboard.

17. A sandwich wrap comprising:

a paperboard base strip elongated in a longitudinal direction, the base strip including opposing longitudinal ends, at least one tab at one longitudinal end, at least one slit at the other longitudinal end, at least one perforation line extending substantially between the longitudinal ends, and a plurality of fold lines extending substantially in a lateral direction of the base strip, wherein the at least one tab is adapted to be securable within the at least one slit when the base strip is folded; and a paper sheet wrap attached to the base strip and including at least one second tear line substantially aligned with the at least one first tear line, the sheet wrap being shorter than the base strip in the longitudinal direction, longer than the base strip in the lateral direction, and more pliable than the base strip, wherein the longitudinal ends of the base strip extend beyond respective longitudinal edges of the sheet wrap.

18. The sandwich wrap of claim 17, wherein the base strip and the sheet wrap each include two parallel tear lines defining tear strip.

19. The sandwich wrap of claim 18, wherein the tear strip extends from one longitudinal end of the base strip to the other longitudinal end.

20. The sandwich wrap of claim 19, wherein the tear strip includes a transverse cut line dividing the tear strip into two tear strip sections.

* * * * *